US010798799B2

(12) United States Patent
Clout et al.

(10) Patent No.: US 10,798,799 B2
(45) Date of Patent: Oct. 6, 2020

(54) LIGHTING SYSTEM AND METHOD

(71) Applicant: SIGNIFY HOLDING B.V., Eindhoven (NL)

(72) Inventors: Ramon Antoine Wiro Clout, Eindhoven (NL); Anthonie Hendrik Bergman, Nuenen (NL); Jochen Renaat Van Gheluwe, Lommel (BE); Siebe Tjerk De Zwart, Valkenswaard (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/495,827

(22) PCT Filed: Mar. 14, 2018

(86) PCT No.: PCT/EP2018/056334
§ 371 (c)(1),
(2) Date: Sep. 19, 2019

(87) PCT Pub. No.: WO2018/172151
PCT Pub. Date: Sep. 27, 2018

(65) Prior Publication Data

US 2020/0137857 A1 Apr. 30, 2020

(30) Foreign Application Priority Data

Mar. 23, 2017 (EP) ..... 17162485

(51) Int. Cl.
*H05B 45/24* (2020.01)
*H05B 45/14* (2020.01)
*H05B 47/14* (2020.01)
*H05B 47/11* (2020.01)

(52) U.S. Cl.
CPC ..... *H05B 47/11* (2020.01); *H05B 45/14* (2020.01); *H05B 45/24* (2020.01); *H05B 47/14* (2020.01)

(58) Field of Classification Search
CPC ..... G09G 3/007; G09G 3/045; G09G 3/2051; G09G 3/2055; H05B 45/10; H05B 45/14; H05B 45/24; H05B 47/10; H05B 47/11; H05B 47/14
See application file for complete search history.

(56) References Cited

U.S. PATENT DOCUMENTS

| | | | | |
|---|---|---|---|---|
| 9,071,800 | B2 * | 6/2015 | Ikawa | H04N 5/58 |
| 9,142,188 | B2 * | 9/2015 | Kurikko | G09G 3/20 |
| 2002/0008710 | A1 | 1/2002 | Someya et al. | |
| 2004/0070590 | A1 * | 4/2004 | Lee | G09G 3/2022 345/690 |

(Continued)

FOREIGN PATENT DOCUMENTS

EP 1889112 B1 2/2008

*Primary Examiner* — Amy Cohen Johnson
*Assistant Examiner* — Syed M Kaiser
(74) *Attorney, Agent, or Firm* — Daniel. J. Piotrowski

(57) ABSTRACT

The invention provides a lighting system (30) comprising an array (32) of lighting elements (34) being controllable to create a configurable light effect having a configurable luminance distribution. A controller (38) is configured to effect migration of a light effect from a first position (21) to a second position (22) wherein an edge of the light effect is transformed for the duration of the migration so as to improve apparent smoothness of the movement.

15 Claims, 8 Drawing Sheets

(56) References Cited

U.S. PATENT DOCUMENTS

| | | | | |
|---|---|---|---|---|
| 2007/0126757 | A1* | 6/2007 | Itoh | G09G 3/3258 345/690 |
| 2007/0296689 | A1* | 12/2007 | Kimura | G09G 3/3426 345/102 |
| 2008/0068312 | A1* | 3/2008 | Kim | G09G 3/2014 345/84 |
| 2008/0068359 | A1* | 3/2008 | Yoshida | G09G 3/3406 345/204 |
| 2008/0180385 | A1* | 7/2008 | Yoshida | G09G 3/3413 345/102 |
| 2009/0034868 | A1* | 2/2009 | Rempel | G09G 3/3426 382/264 |
| 2009/0179923 | A1* | 7/2009 | Amundson | G09G 3/2018 345/690 |
| 2009/0289414 | A1* | 11/2009 | Bergman | A63F 1/06 273/149 R |
| 2009/0322800 | A1* | 12/2009 | Atkins | G09G 3/3413 345/690 |
| 2010/0098349 | A1* | 4/2010 | Arashima | H04N 5/144 382/263 |
| 2010/0103089 | A1 | 4/2010 | Yoshida et al. | |
| 2010/0302774 | A1 | 12/2010 | Van As | |
| 2011/0122272 | A1* | 5/2011 | Fergason | G09G 3/3406 348/222.1 |
| 2014/0132643 | A1* | 5/2014 | Yamazaki | G09G 3/2018 345/690 |
| 2016/0116979 | A1* | 4/2016 | Border | G02B 27/0093 345/156 |
| 2016/0171935 | A1* | 6/2016 | Ben-Dov | G09G 3/344 345/691 |
| 2017/0299144 | A1* | 10/2017 | Rosen | F21V 5/007 |
| 2018/0352636 | A1* | 12/2018 | Engelen | H05B 47/19 |
| 2019/0254137 | A1* | 8/2019 | Sevo | H05B 45/00 |

* cited by examiner (A)

(B)

(C)

(D)

(E)

LIGHTING SYSTEM AND METHOD

CROSS-REFERENCE TO PRIOR APPLICATIONS

This application is the U.S. National Phase application under 35 U.S.C. § 371 of International Application No. PCT/EP2018/056334, filed on Mar. 14, 2018, which claims the benefit of European Patent Application No. 17162485.1, filed on Mar. 23, 2017. These applications are hereby incorporated by reference herein.

FIELD OF THE INVENTION

This invention relates to a lighting system operable to create a configurable light effect using an array of independently controllable LEDs, and in particular such a lighting system configured to migrate a light effect from a first location to a second, different location.

BACKGROUND OF THE INVENTION

It is known that an array of lighting elements may be controlled to create a configurable light effect. Through coordinated control of the elements of the array, a wide variety of different static or dynamic light effects are achievable. The array of lighting elements may be for projecting a light effect on an incident surface in a space, or may be for creating a light effect across the light output surface of the array itself (as part of a matrix sign for instance).

For certain applications, it is desirable to create a light effect with a configurable position, wherein the light effect may be migrated smoothly from a first location to a second. This may for instance be a spotlight effect having a configurable projection location.

Such migration of a light effect is typically achieved by reconfiguring a selection of lighting elements forming the light effect in a dynamic fashion so as to give the appearance of movement of the light effect across the array from a first location to a second location. In particular, lighting elements of the array are controlled to create at a first location on the array a light output having a particular light luminance distribution, and then to transition this luminance distribution from this first location to a second location.

Where the luminance distribution has a sharply defined edge or boundary (for example where the edge is defined by a step change in intensity from a uniform high intensity level applied across the distribution to a zero level) smooth movement of the luminance distribution across the array is difficult to achieve. In particular, the movement of the distribution must be performed as a series of element-to-element jumps such that the transition creates the appearance of a series of discrete steps across the array. The consequence of this is that the maximal resolution (or smoothness) of the motion is constrained by the resolution (i.e. the pitch) of the array. The greater the pitch of the array, the more fragmented the motion of the light effect will appear.

Light effects having sharply defined boundaries are very common, and may be particularly desirable for instance in cases where a particular shape, figure or even textual matter is desired to be output in a clear and well-defined manner. It would be highly desirable for aesthetic reasons to enable smoother transitioning of such light effects in the case that dynamic motion of the effect is to be created.

Means for improving the perceived smoothness of motion of such light effects when controlled to transition from a first location to a second location is therefore desired.

SUMMARY OF THE INVENTION

The invention is defined by the claims.

According to an aspect of the invention, there is provided a lighting system comprising: an array of lighting elements, each of said lighting elements having a configurable light output intensity; a controller operatively coupled to said array and configured to individually control the light output intensities of said lighting elements in order to generate a configurable light effect in a configurable location, the configurable light effect having a configurable luminance distribution exhibiting a defined edge steepness, wherein: the controller is responsive to a control instruction instructing the controller to migrate a current light effect in a first location to a second location spatially separated from the first location along a path between the first location and the second location; wherein the controller is adapted to reduce the edge steepness of the luminance distribution of the current light effect for the duration of its migration along said path, and wherein said control instruction further instructs a speed at which said current light effect is to be migrated along said path from the first location to the second location, the controller may be adapted to reduce the edge steepness only in the case that said speed is below a defined threshold speed level.

The invention is based on the concept of implementing a split-mode approach to rendering of the light effect, wherein in particular the edge of the light effect is rendered differently depending upon the effect is being controlled to move or whether it is being controlled to remain static. During moments in which the light effect is static, the edge of the luminance distribution forming the light effect may have any desired steepness. During moments in which the light effect is moving however, the edge of the light effect is controlled to effect a reduction in steepness (or at least to ensure that the steepness is already below a defined threshold). As a result, the edge becomes blurred or softened for the course of its migration by spreading a fall-off in the intensity of the effect at its edge over a greater distance, and in particular over a greater distance relative to the pitch of the array. By thus blurring or spreading the edge of the light effect, the visual impact of the light effect translation is reduced, since there is not the appearance of such a sharp jump in the position of the light effect as it moves between lighting elements. Rather, movement of the more dispersed light effect creates the impression of a more gradual, wavelike progression in the luminance distribution across the array.

By way of example, consider a light effect characterised, when static, by a luminance distribution delineated at its edge by a step-change in intensity, the intensity dropping suddenly from a relatively high level to a zero level in a step of just a single lighting element. The luminance distribution may for instance resemble a square wave. In accordance with embodiments of the present invention, upon commencement of any movement of the light effect (or immediately prior to such movement) the boundary of the light effect may be transformed so as to describe a more gradual drop-off in intensity, spread for instance over several lighting elements. Movement of this light effect has a smoother appearance than that of the square wave-like light effect.

In addition, since in the second case the edge is spread over a greater number of lighting elements, an additional capacity is introduced to create the impression of an apparent translation of the light effect without repositioning it to a different set of lighting elements. This is achieved by simply skewing the luminance distribution slightly in a given direction across the already illuminated lighting elements (rather than by translating the whole effect). By skewing the distribution, a centre of the luminance distribution may be consequently shifted, giving the impression that the overall position of the light effect has changed. A skewing of the distribution thus enables an apparent translation of the light effect by amounts which are smaller than width of a single lighting element.

By combining this with appropriately timed inter-lighting element shifts of the light effect across the array, a migration of the light effect through any desired distance can be effected with a significantly increased smoothness and continuity. The generated effect is essentially that of a propagating travelling wave of intensity moving across the array, as opposed to a movement formed of a series of discrete steps.

By controlling the light effect such that its edge steepness is reduced only during moments of motion, a more sharply defined light effect can be retained during static moments. As mentioned above, a more sharply defined boundary (with greater edge steepness) may be preferred in the static case for reasons of clarity and precision of reproduction of the emitted light effect. This may for instance be particularly important in cases of rendering precise shapes, patterns, pictures or textual matter.

For the purposes of the present disclosure 'edge steepness' refers generally to the steepness of a drop-off in intensity occurring at the boundary of any rendered light effect. It may refer to a gradient of a slope in intensity occurring at the edge of the rendered light effect. For example, a steepest possible edge might be that formed by a step-change in intensity between a relatively high intensity level (e.g. applied uniformly across the extent of the light effect) to a zero intensity level. The next steepest edge might be defined by a drop-off in intensity occurring over just two lighting elements, the intensity declining from 100% to 50% to 0%. By appropriately controlling intensities of the lighting elements at the edge of the light effect, the rate of decline in intensity can be adjusted and the edge spread over a varying spatial distances.

The reduction in edge steepness may be performed in advance of commencement of motion of the light effect, or may be performed during movement of the light effect. It may be preferable to complete the reduction in advance of beginning motion (or at least as soon as possible after commencement of motion) such that the edge transition is in place for as much of the migration of the light effect as possible.

The term 'luminance distribution' refers to the spatial distribution of luminance, luminance being a photometric measure of the luminous intensity (wavelength-weighted power per unit solid angle) per unit area of light travelling in a given direction (units candela per square metre). Although this particular physical quantity is used in this application to characterise and define the effects of the invention it will naturally be understood by the skilled person that, given the various one-to-one relationships that exist between this quantity and other related photometric quantities (such as for example luminous emittance distribution) that a number of other quantities could equally well be used to characterise and describe the invention. The relation with luminance is not fundamental to the invention but merely represents one particularly convenient and useful way of describing and defining the optical characteristics of the invention.

The visibility of dynamic artefacts in the movement of the light effect (i.e. discontinuities in its motion) is strongly related to the speed at which the light effect is moving; the faster the effect is moving, the less obvious are the artefacts and vice versa. Hence, where said control instruction further instructs a speed at which said current light effect is to be migrated along said path from the first location to the second location, the controller may be adapted to reduce the edge steepness only in the case that said speed is below a defined threshold speed level, resulting in less load on the controller and enabling higher moving speed of the light effect. The threshold speed level may be pre-defined and stored locally, for instance within a memory integral to the controller or communicatively coupled to the controller, or may be provided to the controller remotely via a suitable remote communication channel. The controller individually controls and updates the light output intensities of said lighting elements at a certain refresh rate requiring a certain refresh time. The movement of the light effect from one lighting element to its adjacent lighting element at a certain speed level requires a certain moving time. The threshold speed level may be defined in terms of moving time and refresh time. Hence, the threshold speed level for initiating the edge steepness reduction may, for example, be pre-defined as when the moving time is larger than the refresh time, or, for example, the moving time is twice the refresh time. Alternatively, the threshold speed level may be defined as an exact value expressed in m/s, for example, the threshold speed level is 5 m/s, 2 m/s or 1 m/s. Below these values the edge steepness reduction is activated in the lighting system.

In accordance with one or more embodiments, the controller may be adapted to reduce said edge steepness only if the steepness exceeds a pre-defined threshold. If the edge is already sufficiently shallow to enable transition of the light effect with subjectively acceptable smoothness, it would not be necessary to further reduce its steepness. A sufficiently shallow edge might for example be an edge that extends over a distance at least greater than a certain multiple of the pitch of the array. This multiple may be defined in advance in accordance with a subjective judgement as to an acceptable smoothness of transitions. By further including an initial analysis step in which said edge is compared with a threshold steepness, it can be determined whether it is necessary to apply the steepness reduction, and, if not, potentially conserve processing resources of the controller.

The threshold may be quantified in any suitable manner, for instance in terms of a gradient of the intensity drop off at the edge of the luminance distribution or in terms for instance of a distance over which said intensity drop off-extends (this being defined for example in spatial units, or in terms of multiples of lighting elements).

The defined threshold may be pre-defined and stored locally by the controller, for instance within a memory integral to the controller or communicatively coupled with the controller. Alternatively, the controller may be provided with means for connecting with a remote server such as a cloud-based server or other remote data source for accessing or being provided with said threshold.

One means of defining the threshold may be in terms of the pitch of the array. For instance, in accordance with at least one set of embodiments, where said array has a defined pitch, the controller may be adapted to identify a width of said edge of the luminance distribution and to reduce the edge steepness only if said identified width is less than a width of said defined pitch. By 'pitch' is meant a separation distance between neighbouring lighting elements of the array. In accordance with these embodiments, the edge steepness is only reduced if the edge of the luminance distribution extends over a distance which is less that the distance between each pair of neighbouring lighting elements. The result of this is to effectively limit reduction of the edge steepness only to those cases in which the edge forms a step-change type boundary described above, dropping sharply from a high level to a zero level over the course of just a single lighting element.

The 'width' of the edge may in examples be spatially defined. The width may be defined for example as the distance between a point of maximum intensity of the luminous distribution and a point of minimum intensity of the luminous distribution; i.e. the nearest point of the luminous distribution to the point of maximum intensity at which the intensity has fallen below a defined threshold or has become zero. However any other suitable definition of edge width may also be used, for example being defined non-spatially (e.g. in terms of multiples of lighting elements), or extending between different reference points of the luminous distribution.

The width may be measured and defined differently depending upon the shape of the rendered light effect. In all cases, the width of the edge is measured in a direction extending outwards from a centre of the luminance distribution. Where the light effect is circular or elliptical for example, the width may mean a radial width.

In further variations to above embodiment, the threshold width of the edge may be defined in terms of larger multiple of the defined pitch of the array.

In accordance with preferred examples, the controller may be adapted to maintain a total luminous flux of the light effect constant upon reducing said edge steepness of the luminance distribution. This may reduce the visual impact of performing the transformation, rendering the transition more seamless to observers. By 'constant flux' may be meant a constant power (e.g. luminous power) of the light effect. The controller may ensure that the aggregate output power or flux of lighting elements forming the light effect is the same before and after transformation of the edge steepness.

Where the transformation of the edge does not increase the size of the light effect, this may require increasing the output intensity of some of the lighting elements (for example those positioned more centrally within the distribution) so as to compensate for the reduction in output power of some of the elements within the newly expanded edge region of the light effect.

In accordance with at least one set of embodiments, the controller is adapted to reduce said edge steepness by increasing the total area covered by the light effect and spreading the edge of the light effect outwards into said increase in area. Where the total flux is to be maintained within these embodiments, no increase in output power or flux may be necessary for any of the lighting elements forming the light effect. Rather, maintenance of the total flux may require reducing the output power or flux of some of the more central lighting elements so as to account for the added flux being provided by the newly added light effects at the extended edge region.

Effecting the reduction in edge steepness by extending the size of the light effect may generally be preferable, especially in cases in which a light effect is being generated by an initially relatively small number of lighting elements. Here, effecting the necessary spreading of the edge without expanding the size may be difficult. Additionally, as noted above, effecting the reduced steepness without increasing the size while also maintaining a constant total flux requires increasing the output intensity of at least a portion of the lighting elements forming the light effect. This may be undesirable since it necessitates illuminating the light effects at an initially lower level than their maximal capability so as to leave capacity to increase the intensity upon flattening of the edge. Hence in general the static light effect may be dimmer than in cases where reduction in the edge steepness is effected by increasing a size of the light effect.

In accordance with one or more examples, the light effect may be controlled to change, for instance in shape, between said first position and said second position, such that the migrated light effect at the second location is different to the light effect at said first location. This transition may be performed in a smooth continuous manner across the whole duration of said migration or may be performed all at once for instance at the beginning or end of the migration.

In accordance with at least one set of embodiments, the luminance distribution of the current light effect may at least partially follow a Gaussian distribution, and the controller may be adapted to reduce said edge steepness of the distribution through increasing a width of said Gaussian distribution. The distribution may follow a 'truncated Gaussian' distribution, wherein the intensity drops discontinuously to zero at defined points at the edges of the distribution. The width of the Gaussian distribution may by way of example be quantified by the full width at half maximum (FWHM) of the Gaussian distribution. The FWHM typically may not correspond with a width of the edge of the distribution (since it will typically stop short of said artificial truncation points at the very boundary of the distribution), but does provide a representative parameterisation of the width of said edge, since as the FWHM increases, the edge width also increases dependently.

In addition to the speed of the light effect, the visibility of dynamic artefacts is also strongly dependent upon the direction of travel of the effect relative to the alignment axes of elements forming the array (e.g. the directions of rows and columns in the case of a square array). In particular, where the motion of the light effect extends parallel with any of said alignment axes the visibility of discontinuities in the motion may be significantly reduced. As the trajectory of travel increasingly deviates from perfectly parallel alignment, the visibility steadily increases until a point is reached at which the discontinuity becomes visually unacceptable.

Hence, in accordance with at least one set of embodiments, where the lighting elements of the array are arranged in a grid formation defined by a set of intersecting axes, the controller may be adapted to reduce said edge steepness only in the case that at least a portion of said path between said first location and said second location extends relative to any of said axes defining said grid at an angle which exceeds a defined threshold angle. The threshold angle may be predefined in accordance for example with a subjective judgment of the point at which the visibility of the motion artefacts becomes unacceptable.

Where the path of the light effect is non-linear, the edge may be dynamically varied throughout migration of the light effect so as to reduce in steepness during portions of the path exceeding the angular deviation threshold and to restore the edge steepness during portions not exceeding the threshold.

In accordance with one or more embodiments, the lighting system may further comprise a data communication interface communicatively coupled to the controller for receiving said control instruction, and optionally wherein the data communication interface is for receiving one or more user input commands.

In accordance with any embodiment of the invention, the controller may be adapted to reduce said edge steepness in a continuous manner. By 'continuous' is meant that the steepness is transitioned gradually from an initial steepness to an altered, lower steepness, rather than being changed in a discontinuous manner. This may reduce the visual impact of the transition and increase the aesthetic qualities of the transition process.

In accordance with one or more embodiments, the array may be comprised within an encompassing lighting unit, for example further comprising optical elements for steering and/or focussing the light output of the array. The controller may be provided locally to the array, for example integrated within such an encompassing lighting unit. Alternatively, the controller may be remote to the array, the two being associated only operatively via a suitable communication channel. Said communication channel may for instance be a wired or wireless network link and/or an Internet-based connection.

Examples in accordance with a further aspect of the invention provide a method of generating a configurable light effect through control of an array of lighting elements, the lighting elements each having a configurable light output intensity and the configurable light effect having a configurable luminance distribution exhibiting a defined edge steepness, and the method comprising: controlling the lighting elements to migrate a current light effect in a first location to a second location spatially separated from the first location along a path between the first location and the second location, and further comprising reducing said edge steepness of the luminance distribution of the current light effect for the duration of its migration along said path and setting a threshold speed level below which edge steepness reduction is activated.

As described above, said edge steepness may in particular examples be reduced only if the steepness exceeds a predefined threshold.

Furthermore, where said array has a defined pitch, the method may comprise identifying a width of said edge of the luminance distribution and reducing the edge steepness only if said identified width is less than a width of said defined pitch. As noted above, the pitch of the array may provide a suitable metric for assessing the initial steepness of the edge, and avoid transforming the edge needlessly in the case that the edge is already shallow enough to enable sufficiently smooth motion of the light effect.

In accordance with one or more embodiments, the edge steepness of the luminance distribution may be reduced while maintaining a constant total luminous flux of the light effect. As noted above, this may reduce the visual impact of the edge transition.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting system comprising an array of lighting elements, being controllable to create a configurable light effect having a configurable luminance distribution. A controller is configured to effect migration of a light effect from a first position to a second position wherein an edge of the light effect is transformed for the duration of the migration so as to improve apparent smoothness of the movement.

Embodiments of the invention are based on the insight that a light effect having a shallower edge enables smoother apparent motion of the light effect across the array than a light effect having a sharply defined (steep) edge. This is in part due to the fact that for a steep-edge light effect, it is not possible to shift the intensity profile defining the light effect less than the width of an entire lighting element without distorting or deforming the luminance distribution, thereby creating artefacts in the apparent motion. This is because the resolution (or smoothness) of movement of the light effect is effectively limited to the resolution of the array, i.e. the distribution can only be moved in single lighting element steps. By contrast, for a light effect having an intensity profile with a smoothly tapering edge, it is possible to shift the intensity profile by distances smaller than a single lighting element by simply skewing the luminance distribution by a small amount.

Figure 1:
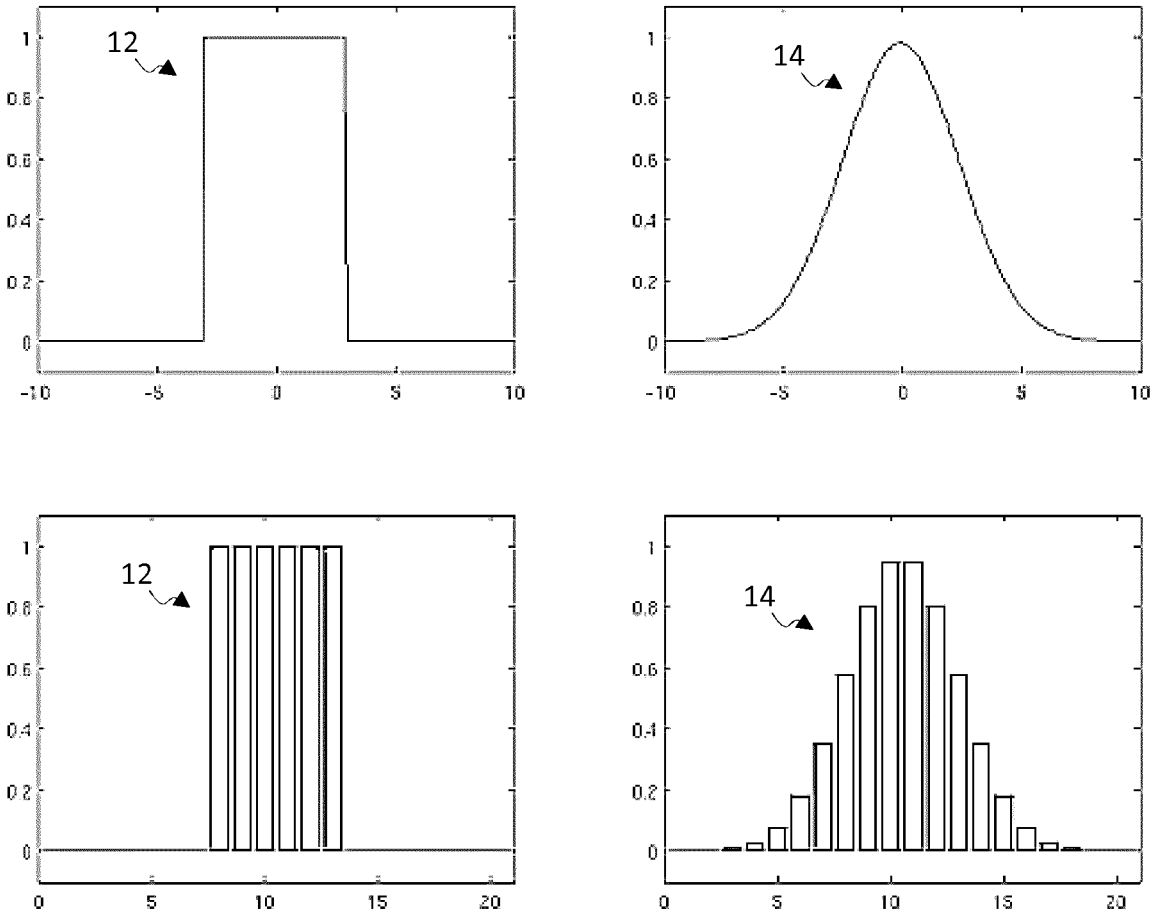
FIG. 1 shows luminance distributions (luminous intensity as a function of position) of each a steep-edge and shallow-edge light effect.
Figure 2:
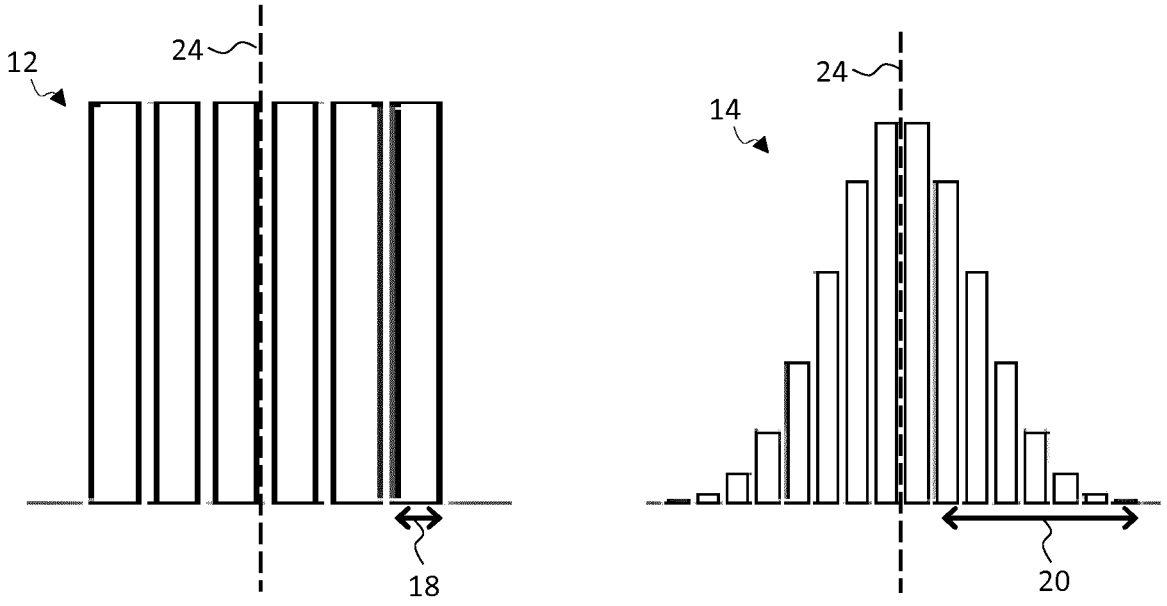
FIG. 2 depicts an edge width of each of the luminance distributions of FIG. 1.

This phenomenon is illustrated schematically in FIGS. 1 to 4 which show the effect of shifting each of a steep-edge light effect 12 and a shallow edge light effect 14 by a distance of 0.7 times the width of single lighting element. FIGS. 1 and 2 show the luminance distributions of the two light effects in an initial, un-shifted state. Although the illustrations show a light effect in a single dimension, the principle extends to luminance distributions in two dimensions.

The top-left and top-right images of FIG. 1 illustrate the first 12 and second intensity 14 distributions respectively as a graph of relative intensity (x-axis) versus distance (y-axis, arbitrary units). The bottom-left and bottom-right images illustrate the same luminance distributions in terms of the sets of lighting elements forming the luminance distributions and their respective intensity outputs. The x-axis represents an index number of the lighting element in the array, while the y-axis represents the relative intensity output of each lighting element. As can be seen, the steep edge luminance distribution 12 is formed from a set of six contiguously positioned lighting elements, each illuminated with a uniform intensity output (relative intensity 1). By contrast, the shallow edge luminance distribution is formed by a set of sixteen contiguous lighting elements being illuminated by a set of smoothly varying light intensity outputs, collectively defining the distribution 14 shown in the top-right image of FIG. 1.

FIG. 2 schematically illustrates a respective edge width of each of the first and second luminance distributions. For the steep-edge luminance distribution 12, the intensity declines sharply from a uniform maximum intensity level to zero intensity over the course of a single lighting element. Hence, for the first luminance distribution, the edge width 18 may be defined as equal to the width of a single lighting element.

For the shallow-edge luminance distribution 14, the intensity declines gradually over the course of eight lighting elements, from a maximum relative intensity 1 to a relative intensity of 0. Hence, for the second luminance distribution, the edge width 20 may be defined as equal to the width of eight lighting elements.

FIG. 2 also indicates a central point 24 of each of the first 12 and second 14 luminance distributions, being the point at which the sum of the intensities on either side (or the definite integral of the luminance distribution either side) is equal. The centre 24 of the luminance distribution typically represents the point perceived by observers to be the overall 'location' or position of the distribution when displayed on the array or projected by the array onto an incident surface.

Figure 3:
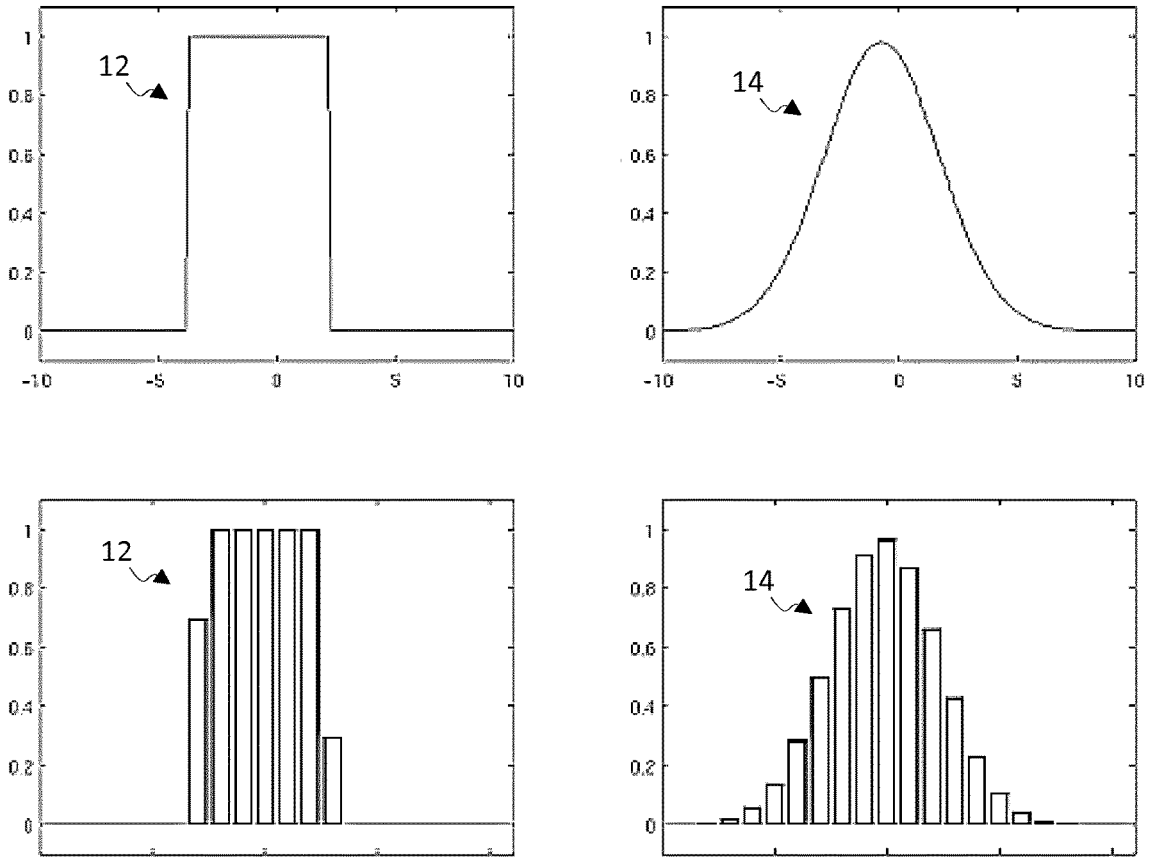
FIG. 3 shows the luminance distributions of FIG. 1 translated by 0.7 times the pitch of the array of lighting elements.
Figure 4:
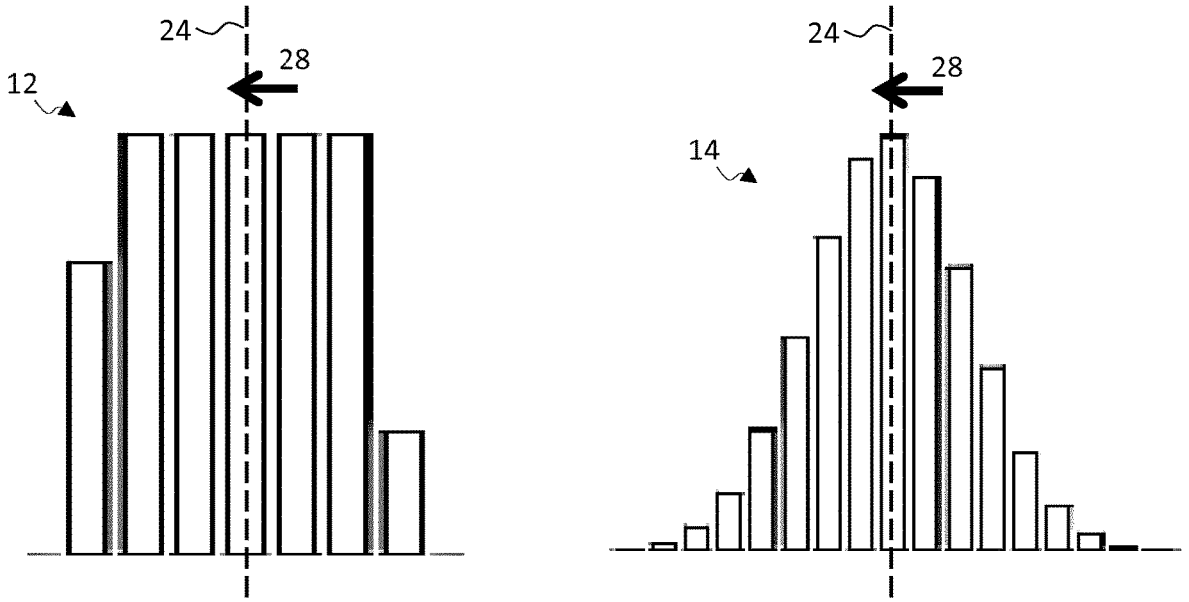
FIG. 4 indicates a shift in the centre of each of the translated distributions of FIG. 3.

FIGS. 3-4 show the first and second luminance distributions each having been shifted (i.e. having their central point 24 shifted) by a distance equal to 0.7 times the width of a single lighting element. Arrow 28 in FIG. 4 illustrates the direction of this movement, and it can be seen in each of the images of FIG. 4, that the central point 24 of each distribution has moved very slightly leftward to reflect the effected shift.

FIG. 3 shows the effect on each of the first 12 and second 14 luminance distributions. It can be seen that for the steep-slope distribution 12, a shifting of the distribution centre 24 by a non-integer multiple of lighting elements has the effect of distorting the overall shape and profile of the distribution. In particular, it can be seen that the lighting element has been forced to spread over a greater total number of lighting elements (now covering eight instead of six), and the two edges of the light effect are noticeably asymmetrical, giving a distorted appearance. It can therefore be seen that the steep-edge luminance distribution 12 can only be translated in an undistorted form if it is translated in integer lighting element steps. The movement of the steep-edge light effect 12 is effectively confined by the size of the pitch of the array.

By contrast, it can be seen that for the shallow-edge luminance distribution 14, the non-integer shift in the centre of the distribution does not lead to any noticeable distortion in the overall distribution. Rather, the overall shape of the distribution remains fundamentally unchanged, but with its central point moved very slightly leftward. The shift manifests in a slight skewing of the luminance distribution in the direction of the movement, such that the intensities of the lighting elements forming the distribution are no longer symmetrically disposed about the centre point, but are rather weighted slightly toward the left hand side of the distribution.

Hence it can be seen movement of the centre of a shallow-edged luminance distribution (and hence the perceived movement of the overall position of such a distribution) can be effected by amounts smaller than the distance of a single lighting element without fundamentally distorting the overall shape of the distribution, or expanding the total number of lighting elements over which the distribution spans. As a result, it is possible to effect smoother apparent motion of a shallow-edged light effect, since the resolution of its motion is not confined by the resolution of the array.

Recognition of the above described disparity in dynamic properties of steep-edge compared with shallow edge luminance distributions forms the basis of embodiments of the present invention. The invention is based on improving the smoothness of motion of sharp-edged light effects upon translation across an array by pre-processing the edge of the distribution in advance of movement so as to temporarily reduce its steepness. Once motion is complete, the steepness can be once again returned to its initial sharp level.

Figure 5:
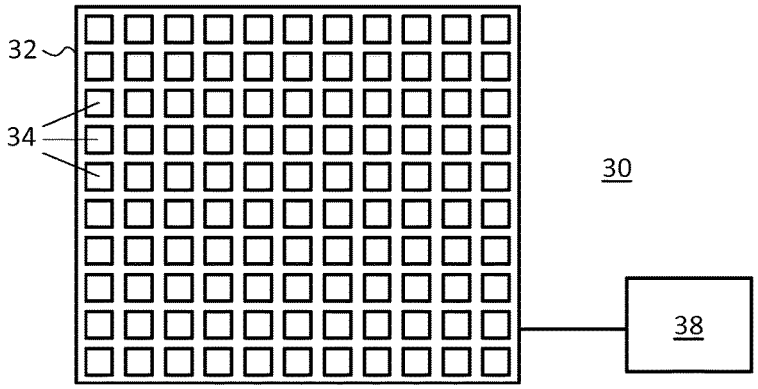
FIG. 5 schematically depicts an example lighting system in accordance with an embodiment of the invention.
Figure 6:
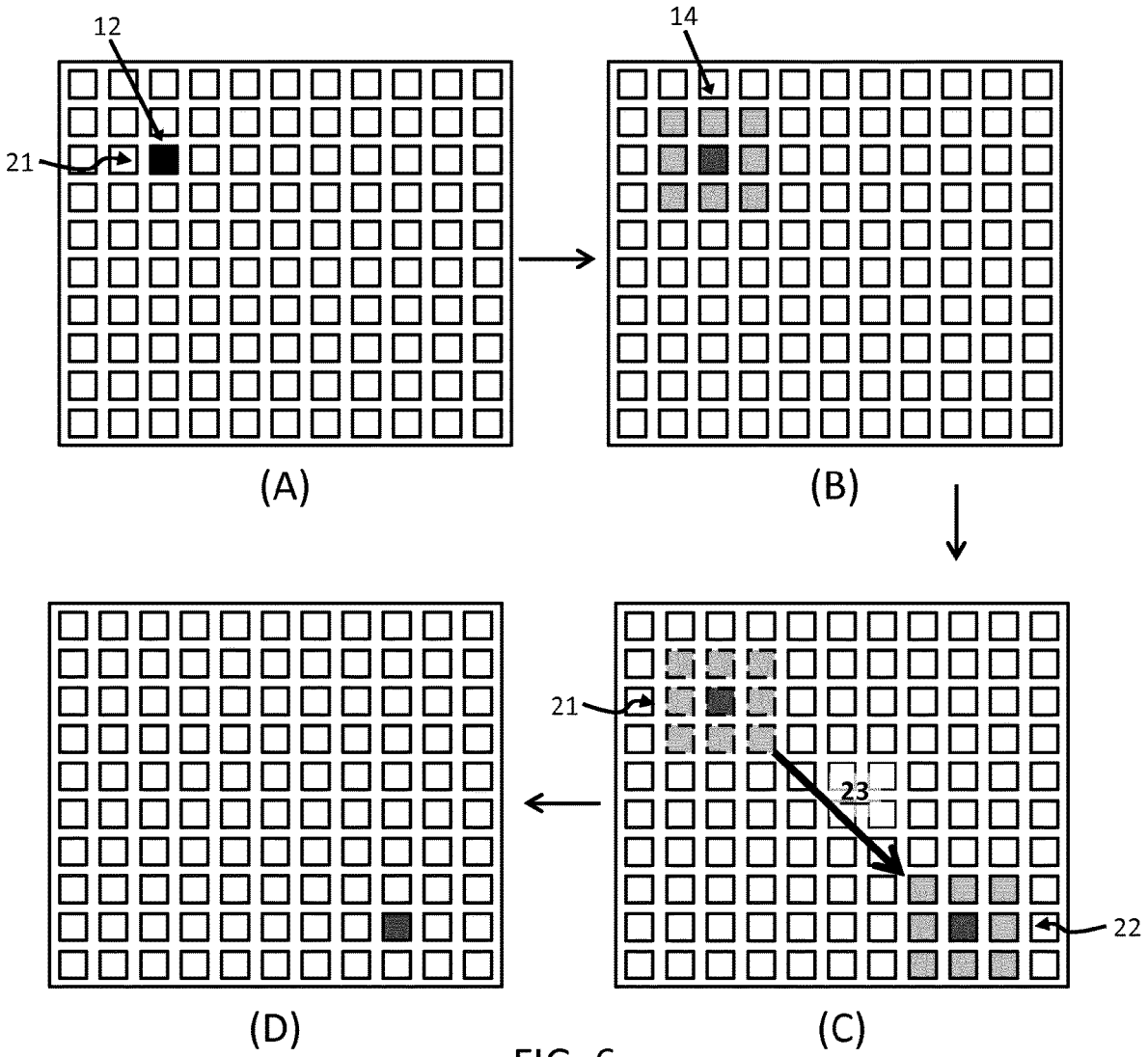
FIG. 6*a-d* schematically illustrate control steps implemented by the lighting system of FIG. 5 to effect migration of a light effect in accordance with the invention.

This is illustrated schematically in FIGS. 5 and 6 which show a first example lighting system 30 in accordance with an embodiment of the invention, and its control so as to realise the improvements in the dynamic behaviour of a migrating light effect.

FIG. 5 schematically depicts the functional configuration of an example lighting system 30. The system comprises an array 32 of lighting elements 34, each of said lighting elements having an independently configurable light output intensity. A controller 38 is operatively coupled to the array and is operable to control said lighting elements so as to realise a configurable light effect having a configurable luminance distribution. The controller is in particular configured to be responsive to a control instruction instructing it to migrate a particular current light effect from a first position to a second position on the array, wherein the steepness of the edge of the luminance distribution defining said light effect is reduced for the duration of the migration.

The control instruction may in examples be communicated to the controller remotely, for instance via a suitable data communication interface communicatively coupled with the controller. The control instruction may be communicated via any suitable data or network link, including for instance a local or wide area network link or an Internet connection. Additionally or alternatively a control instruction may be provided to the controller via a suitable user interface device. The user interface device may be a part of the lighting system or may be separate from the system and communicatively linkable to the controller. The control instruction may in examples define the spatial luminance distribution of the light effect when in a static state, as well as an intended direction, distance and possibly speed of motion of the light effect. Alternatively, the control instruction may simply specify the initial luminance distribution of the light effect along with a starting and finishing position on the array, wherein the controller is configured to calculate an appropriate movement path.

The controller 38 may be provided locally to the array 32 or may be situated remotely from the array, the two in the latter case being associated only operatively via a suitable communication channel. Said communication channel may for instance be a wired or wireless network link and/or an Internet-based connection for instance. Any other suitable form of communication channel may alternatively be used as will be apparent to the skilled person.

The controller 38 can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs). In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform the required functions. Various storage media may be fixed within a processor or controller or may be transportable, such that the one or more programs stored thereon can be loaded into a processor or controller.

In accordance with preferred embodiments, the lighting elements 34 populating the array may comprise one or more LED light sources. However, any other light source may alternatively be used such as for instance other varieties of solid state light source (such as OLEDs) as well as for instance incandescent light sources and fluorescent light sources.

In accordance with examples, the array may be comprised within an encompassing lighting unit, for example further comprising optical elements for steering and/or focussing the light output of the array. Where the controller is provided locally to the array, it may for instance be integrated within such an encompassing lighting unit.

FIG. 6 schematically illustrates control of the array 32 of lighting elements 34 to realise migration of an example light effect in accordance with embodiments of the invention. In a first step (A), the controller, responsive to a corresponding control instruction, controls the array 32 to create a first light effect 12 at a first static location 21 on the array. In response to the same or a different control instruction instructing that a migration of the light effect from said first location to a second location 22 should be effected, the controller, in step (B), first pre-processes the light effect to thereby transform it into a further transformed light effect 14 having a luminance distribution with an edge shallower than that of the first light effect 12.

Once transformation of the light effect is complete, the controller 38, in step (C), controls the lighting elements 34 of the array to migrate the light effect in a continuous manner across the array along a path 23 from the first initial position 21 to a second position 22.

Once the light effect has been thus migrated, the controller finally, in a fourth step (D), reverses the transformation applied in step (B) to thereby restore the light effect to the initial starting light effect 12 having a relatively steep edge.

Thus the controller 38 essentially implements a dual mode approach to the rendering of the light effect, wherein the effect is rendered having a sharply defined boundary when it is controller to remain static and the effect is rendered having a more disperse or blurred boundary when controlled to move. In this way a compromise can be realised between ensuring clear and sharp rendering of light effects in moments of stasis, during which an observer may be likely to examine them in more detail, and ensuring smooth observable motion of the light effect during any migration.

The effect of this control behaviour is illustrated with greater clarity in FIGS. 7(A)-(E) which semi-schematically depict the observable appearance of each of a series of example light effects being moved diagonally across an example array. The increasing brightness of the effect in each image schematically illustrates a direction of travel of each light effect. Each successive image from (A) to (E) illustrates a light effect of successively declining edge steepness.

Figure 7:
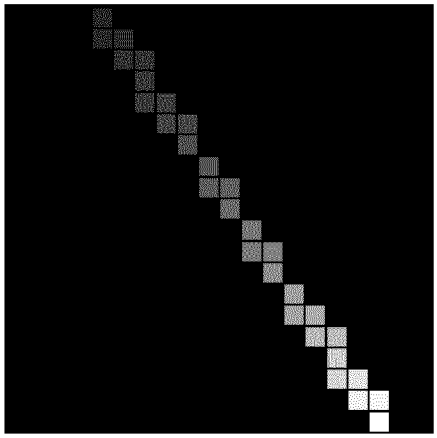
FIG. 7*a-e* illustrate different observable motion paths for light effects having edges of different steepness.
Figure 7:
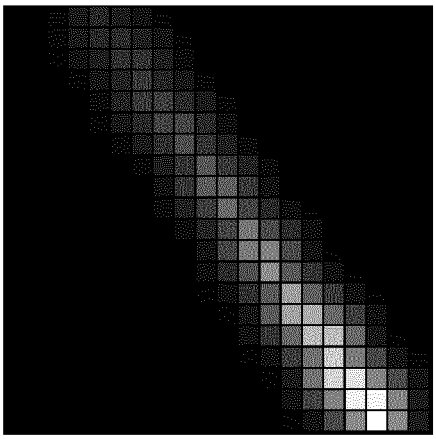
Figure 7:
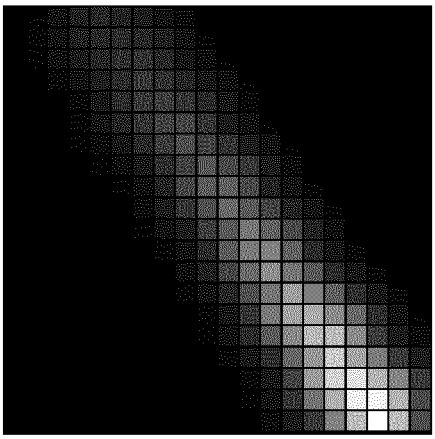
Figure 7:
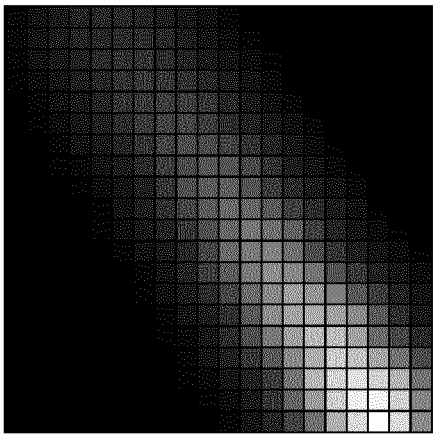
Figure 7:
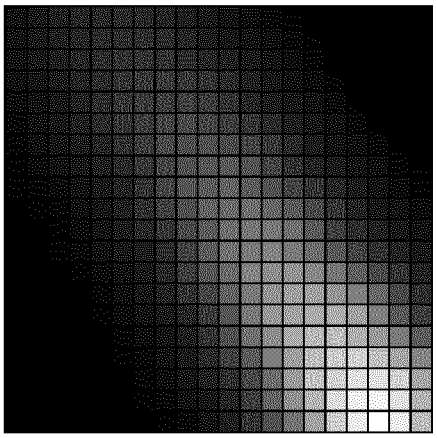

As can be seen from the images, observable motion of the first and more sharply defined light effect (FIG. 7(A)) appears fairly discontinuous, with the light effect not following a clearly defined, smooth path, but rather describing a more jagged and distorted path. By contrast, as the light effect edge becomes increasingly more dispersed, the apparent motion of the light effect becomes significantly smoother, with the motion path of the final light effect (E) appearing almost perfectly continuous.

In accordance with one or more embodiments (and with reference to FIG. 6) at least one of the starting static luminance distribution 12 and the temporary transformed luminance distribution 14 may follow a Gaussian distribution. Preferably both the static light effect 12 and the transformed moving light effect 14 are defined by a Gaussian luminance distribution, and wherein the transformation from the first 12 to the more shallow-edged second 14 light effect is realised by increasing a width of the Gaussian distribution. The width may for instance be reduced continuously so as to generate the appearance of a smooth transition.

A Gaussian distribution in the intensity may be expressed in the following general form:

$$I(x, y) = I_0 \exp\left(\frac{(x - x_0)^2 + (y - y_0)^2}{2b}\right)$$

where $I_0$ represents an intensity amplitude, x and y are position co-ordinates of the array, (xo, $y_0$) define a position of the light effect on the array and b represents a width of the distribution. The steepness of a Gaussian distribution is inversely related to its width. Hence by increasing the width b, it is possible to transform an initial light effect having a steep edge to a second light effect having a shallower edge.

The Gaussian luminance distribution may in examples be a truncated Gaussian distribution, wherein the intensity falls discontinuously to zero at defined points toward the edges of the distribution.

Figure 8:
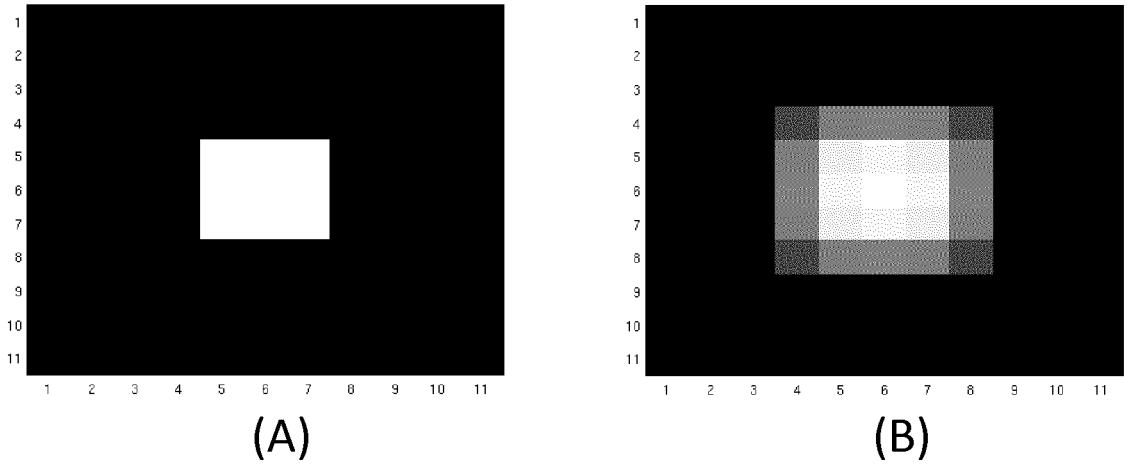
FIG. 8*a-b* schematically depict representation of two example light effects in terms of respective bitmap images.

In accordance with an alternative set of embodiments, each light effect may be defined as a respective bitmap image, wherein a distribution having a shallower edge is represented by a bitmap image having slightly blurred edge regions. This is illustrated in FIG. 8, which shows in image (A) an example light effect having a steep edge and in image (B) an example light effect having a more gradated or shallow edge. In (A), the steep edge is realised by means of a bitmap image in which each pixel takes a value of only black or white. The shallow-edged light effect of (B) is realised by means of a bitmap image in which pixels around an edge region are blurred by means of pixels having values partway between black and white.

As mentioned in the preceding section, the speed at which the light effect is migrated has a strong effect upon the visibility of any dynamic artefacts of the motion of the light effect. In particular, the greater the speed at which the light effect is migrated, the less visible are any artefacts, such as apparent discontinuity in the motion path. Hence, in accordance with one or more embodiments, the controller may be configured to only reduce the edge steepness of the light effect to be migrated in the event that the speed at which it is to be migrated is less than a certain threshold speed level. The intended speed of motion may be communicated to the controller for instance as part of the control instruction to which it is responsive. The minimum threshold speed level may be pre-defined in accordance with a subjective assessment for instance and either stored locally in a memory integral to the controller or coupled with the controller or communicated to the controller remotely.

As also noted above, in addition to the speed of the light effect, the visibility of dynamic artefacts is also strongly dependent upon the direction of travel of the light effect relative to axes of the array (e.g. the directions of rows and columns of the array in the case of a square array). In particular, where the motion of the light effect is parallel with said axes, the visibility of the discontinuity in the motion of the light effect is significantly reduced. As the trajectory of travel increasingly diverges from parallel alignment, the visibility steadily increases until a point at which the discontinuity becomes visually unacceptable.

Hence, in accordance with at least one set of embodiments, where the lighting elements of the array are arranged in a grid formation defined by a set of intersecting axes, the controller may be adapted to reduce said edge steepness only in the case that at least a portion of said path between said first location and said second location extends relative to any of said axes defining said grid at an angle which exceeds a defined threshold angle.

Figure 9:
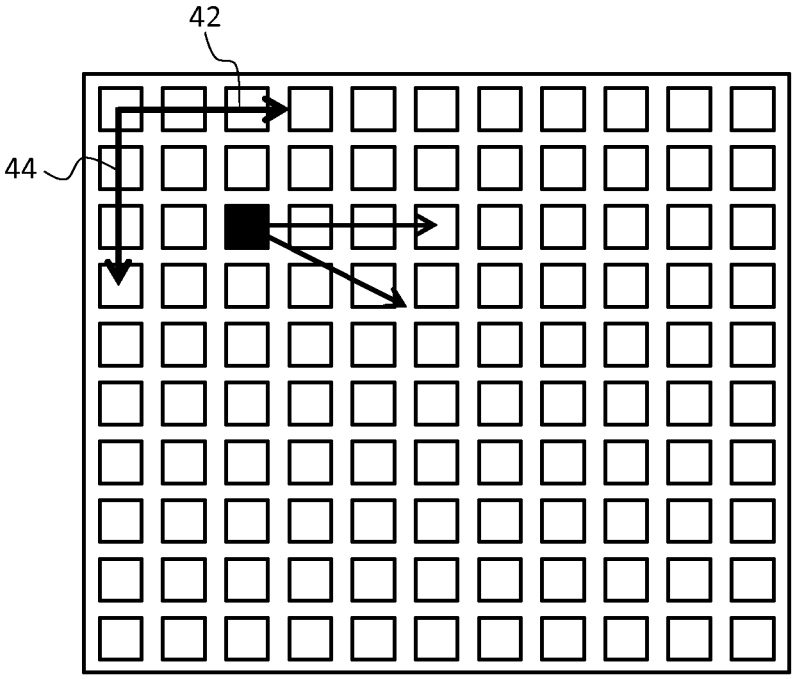
FIG. 9 schematically depicts different directions of motion of light effects across the array relative to orientational axes of the array.

This is illustrated schematically in FIG. 9 which illustrates the alignment axes 42, 44 for the example array of the embodiment of FIG. 5. As shown, the alignment axes are defined by the respective alignment of the rows and columns of the array. Also illustrated in FIG. 9 is an example light effect and two different potential motion paths across the array. A first path extends essentially parallel with the horizontal alignment axis 42. Hence, in accordance with the set of embodiments described above, for motion along this path, the controller may be configured to desist from transforming the edge of the light effect, and simply migrate the effect in its original form. For motion along the alternative illustrated path however, this path being divergent from either of the two alignment axes 42, 44, extending at angle $\alpha$ from horizontal axis 42, the controller may be configured to perform the edge transformation in advance of motion.

In accordance with any embodiment of the invention described above, the reduction in edge steepness may be applied symmetrically to the light effect, such that, for a 2D luminance distribution, the reduction in edge steepness is performed around the entire periphery of the distribution. Alternatively, in accordance with a variant set of embodiments, the reduction in edge steepness may be applied asymmetrically, wherein only those edge regions facing in the direction of motion of the light effect are transformed. This may help to reduce consumption of processing resources without significantly compromising the achieved aesthetic effects, since the apparent discontinuity in the motion of any light effect will be mostly confined to the side of the light effect facing into the direction of motion.

In accordance with any embodiment of the invention, the controller may be adapted to maintain a luminous flux of the light effect constant upon reducing the edge steepness. This may reduce the visual impact of performing the transformation of the edge, such that the transition appears more seamless. By 'constant flux' may be meant a constant (luminous) power of the light effect. The controller may ensure that the sum of all of the output powers or fluxes of the lighting elements forming the array is the same both before and after transforming the edge steepness.

In accordance with embodiments of the invention, there are in general two possible means for reducing the edge steepness of a given light effect. In accordance with a first approach, reducing the edge steepness may be achieved by increasing the total area covered by the light effect and spreading the edge of the light effect outwards into the added area regions. This approach is illustrated in the example of FIG. 6 which shows flattening of the edge of a first light effect 12 by expanding the edge outwards into a newly added peripheral region to thereby arrive at larger, transformed light effect 14.

By contrast, in accordance with a second approach, the edge steepness may be reduced without increasing a size of the light effect by spreading the edge of the effect inwards toward a centre of the luminance distribution. Such an approach is only possible where the light effect is of sufficient initial size to allow for such an inward spreading. For example, for the initial light effect 12 shown in FIG. 6, an inward spreading approach would not be possible, since the initial size of the light effect covers only a single lighting element.

The first approach to reducing the edge steepness may in general be preferable since it is more universally applicable to light effects of any starting size. In addition, where it is desired to maintain a constant luminous flux of the light effect as described above, this is in general simpler to achieve in cases in which an area of the light effect is increased to provide for said steepness reduction.

In particular, where the transformation of the edge does not increase the size of the light effect, maintenance of the overall flux will typically require increasing the output intensity of some of the lighting elements (for example elements further toward a centre of the distribution) so as to compensate for the reduction in output power of some of the elements within the newly expanded edge region of the light effect. This may be undesirable since it necessitates illuminating the light effects at an initially lower level than their maximum capability so as to leave capacity to increase the intensity upon flattening of the edge. Hence, in general, static light effects may be dimmer than in cases in which edge steepness is adjusted by increasing a size of the light effect.

By contrast, where the area is expanded to reduce the edge steepness, no increase in output power or flux is typically necessary for any of the lighting elements forming the light effect. Rather, maintenance of the total flux may be achieved by simply reducing the output power or flux of some of the more central lighting elements so as to account for the added flux being provided by the newly added lighting elements at the extended edge region.

In accordance with embodiments described above, the array of lighting elements may take form suitable for implementing embodiments of the invention described. Typically the array consists of a carrier, such as a planar PCB to which the lighting elements of the array are mounted. Although in the particular examples described and illustrated above, the array is a square or rectangular array, in accordance with further examples the array may be of a different shape, such as for instance circular, elliptical or hexagonal.

As noted above, the array may be comprised within an encompassing lighting device, for example further comprising optical elements for steering and/or focussing the light output of the array. One preferred example of such an encompassing lighting device will now be described in detail with reference to FIGS. 10 to 12.

Figure 10:
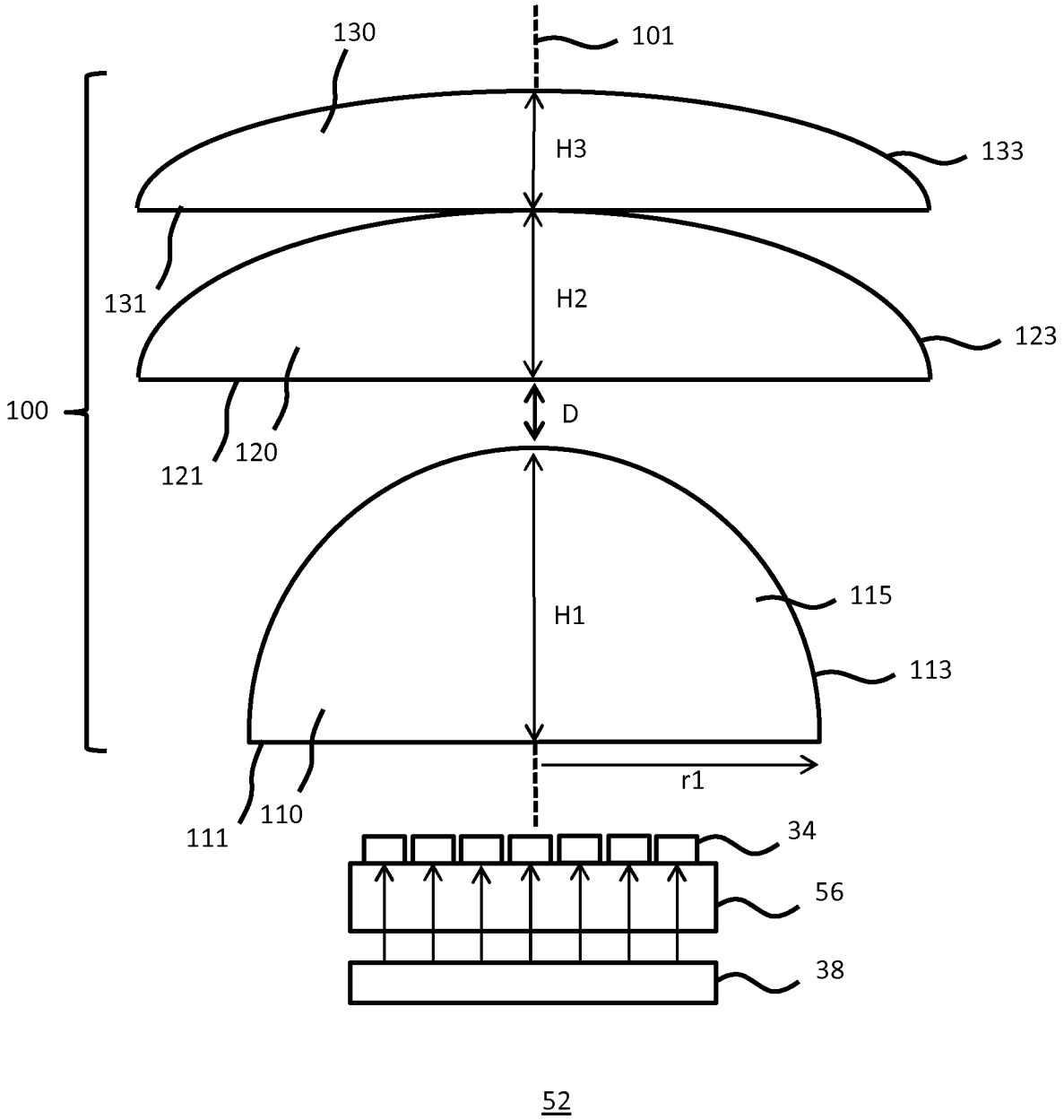
FIG. 10 schematically depicts an example lighting device incorporating an array of lighting elements in accordance with one or more embodiments of the invention.

FIG. 10 schematically depicts a lighting device 52 comprising an array of lighting elements 34 and suitable for use with the present invention. A plurality of lighting elements 34 are arranged in a planar array, each configured to generate a luminous distribution along an optical axis, the respective optical axes of the different lighting elements 34 being in alignment. In the context of the present application it should be understood that small deviations from a perfectly planar array are acceptable; for example, the array may be positioned on a slightly curved surface such that an angular spread of the angles between respective optical axes of the lighting elements 34 does not exceed 5°.

The lighting elements 34 preferably comprise one or more solid-state light sources such as LEDs. The lighting elements 34 may be identical lighting elements, e.g. white light LEDs, or may be different light sources, e.g. different colour LEDs. The lighting elements 34 may be mounted on any suitable carrier 56 such as a printed circuit board or the like. Any suitable type of lighting elements 34 may be used for this purpose. Each lighting element 34 is controlled, i.e. addressed, by the controller 38, the controller being incorporated within the lighting device 52.

As discussed above, the controller 38 may take any suitable form, such as a dedicated controller or microcontroller or a suitable processor programmed to implement the control functionality. The controller 38 may be adapted to individually address each lighting element 34 or may be adapted to address clusters of lighting elements 34. In the context of the present example lighting device, both scenarios will be referred to as the controller 38 being adapted to address a set of lighting elements 34, wherein the set may have only a single member (i.e. the controller 38 is adapted to address individual lighting elements 34) or wherein the set may have multiple members (i.e. the controller 38 is adapted to address clusters of lighting elements 34).

In an embodiment, the lighting elements 34 may be arranged in clusters within the array, with each cluster defining a group of lighting elements 34 arranged to generate light of different colours. The lighting elements 34 in each cluster may for example be placed within a mixing chamber, e.g. a white mixing chamber, or may be placed underneath a mixing light guide such as a glass square or PMMA rod, to generate light of a desired spectral composition. In this embodiment, the controller 38 may be adapted to address individual lighting elements 34 within single clusters such that the controller 38 may change the colour of the light generated by the cluster. In the above embodiments, the addressing of the lighting elements 34 with the controller 38 may include switching the lighting elements 34 between an on-state and an off-state and changing a dimming level of the lighting elements 34.

The controller 38 is responsive to a control instruction. The control instruction may be stored in a local memory of the controller or may be communicated to the controller from a remote source. The control instruction may include a user instruction. A user instruction may be received from a dedicated user interface on the lighting device 52 or a wireless communication module for wirelessly receiving user instructions from a remote controller. A user interface on the lighting device 52 may take any suitable shape, e.g. a touchscreen interface, one or more dials, sliders, buttons, switches or the like or any combination thereof. A wireless communication module may take any suitable shape and may be configured to communicate with the remote controller using any suitable wireless communication protocol, such as for example Bluetooth, Wi-Fi, a mobile communication standard such as UMTS, 3G, 4G, 5G or the like, a near field communication protocol, a proprietary communication protocol and so on.

The remote controller may be a dedicated remote controller that for example is provided with the lighting device 52 or alternatively may be any suitable electronic device adapted for wireless communication that may be configured to act as the remote controller, for example by installing an app or similar software program on the electronic device, which app or software program may be provided with the lighting device 52 or may be retrieved from a network-accessible repository such as an app store over the network, e.g. the Internet. A user of the lighting device 52 in this manner may provide instructions of dynamically adjusting the luminous output of the lighting device 52, which instructions are translated by the controller 38 into addressing signals for addressing selected sets, i.e. one or more sets, of the lighting elements 34 in order to generate the luminous outputs corresponding to the control instructions.

The lighting device 52 is adapted to convert the luminous distributions of the addressed lighting elements 34 into a spotlight (i.e. a light spot) for projection onto a surface, which surface for example may be a shop floor, theatre stage or seating area, a pedestrian walkway, a floor, wall or ceiling of a room in a house, and so on. The lighting device 52 may be a spotlight projector. The controller 38 responsive to the control instruction facilitates the dynamic adjustment of the spotlight in response to a control instruction in order to effect migration of a light effect from a first location to a second location and to effect the reduction in the edge steepness of the generated light effect.

Spotlight adjustments may also include adjustment of the colour of the spotlight, the shape of the spotlight or any combination of these adjustments, for example to attract attention of observers of the spotlight, e.g. shoppers, visitors of an illuminated display space such as a museum, and so on. It is further noted for the avoidance of doubt that the lighting device 52 may be adapted to simultaneously create multiple spotlights, with the position of each spotlight being independently dynamically adjustable as will be readily understood by the skilled person. Each spotlight may be individual controlled in accordance with the invention so as to improve the apparent smoothness of motion of the light in migrating from one location to another.

An optical system 100 is provided common to all the sets of lighting elements 34, which optical system 100 is arranged to receive the respective luminous distributions produced by the lighting elements 34 and to shape these respective luminous distributions into a spotlight having a shape and position determined by the specific set(s) of lighting elements 34 addressed (enabled) by the controller 38. More specifically, the optical system 100 is adapted to project the spotlight in an angular direction relative to its optical axis 101 that is a function of the position of the addressed set of lighting elements 34 within the array of lighting elements 34.

To this end, the optical system 100 comprises a plurality of refractive lenses including a first refractive lens 110 arranged to collect the respective luminous distributions produced by the lighting elements 34 and at least one further refractive lens 120 arranged to collect the light exiting the first refractive lens 110. In the embodiment schematically depicted in FIG. 10, the optical system 100 comprises three plano-convex lenses 110, 120, 130 each having their planar light entry surfaces 111, 121, 131 facing the array of lighting elements 34 and having convex light exit surfaces 113, 123, 133 opposing their respective light entry surfaces. The plano-convex lenses 110, 120, 130 preferably are rotationally symmetric around a shared optical axis 101 and each may be made of any suitable material, e.g. glass or an optical grade polymer such as polycarbonate, poly (methyl methacrylate) (PMMA), polyethylene terephthalate, and so on. The respective lenses 110, 120, 130 may be made of the same material or of different materials, e.g. to tune the refractive index of the respective lenses 110, 120, 130.

The refractive lenses 110, 120, 130 are typically arranged to reduce the beam spread angle of the respective luminous distributions generated with the lighting elements 34, i.e. to increase the degree of collimation of these respective luminous distributions in order to convert these luminous distributions into a light beam with a high degree of collimation such that the luminous output of the optical system 100 takes the shape of a spotlight when projected into the far field, i.e. at a distance several orders of magnitude greater than the focal length of the optical system 100, such as for example at a distance of 1 m, several metres or more. This is explained in more detail with the aid of FIG. 11, in which the optical function as implemented by the optical system 100 is schematically depicted.

Figure 11:
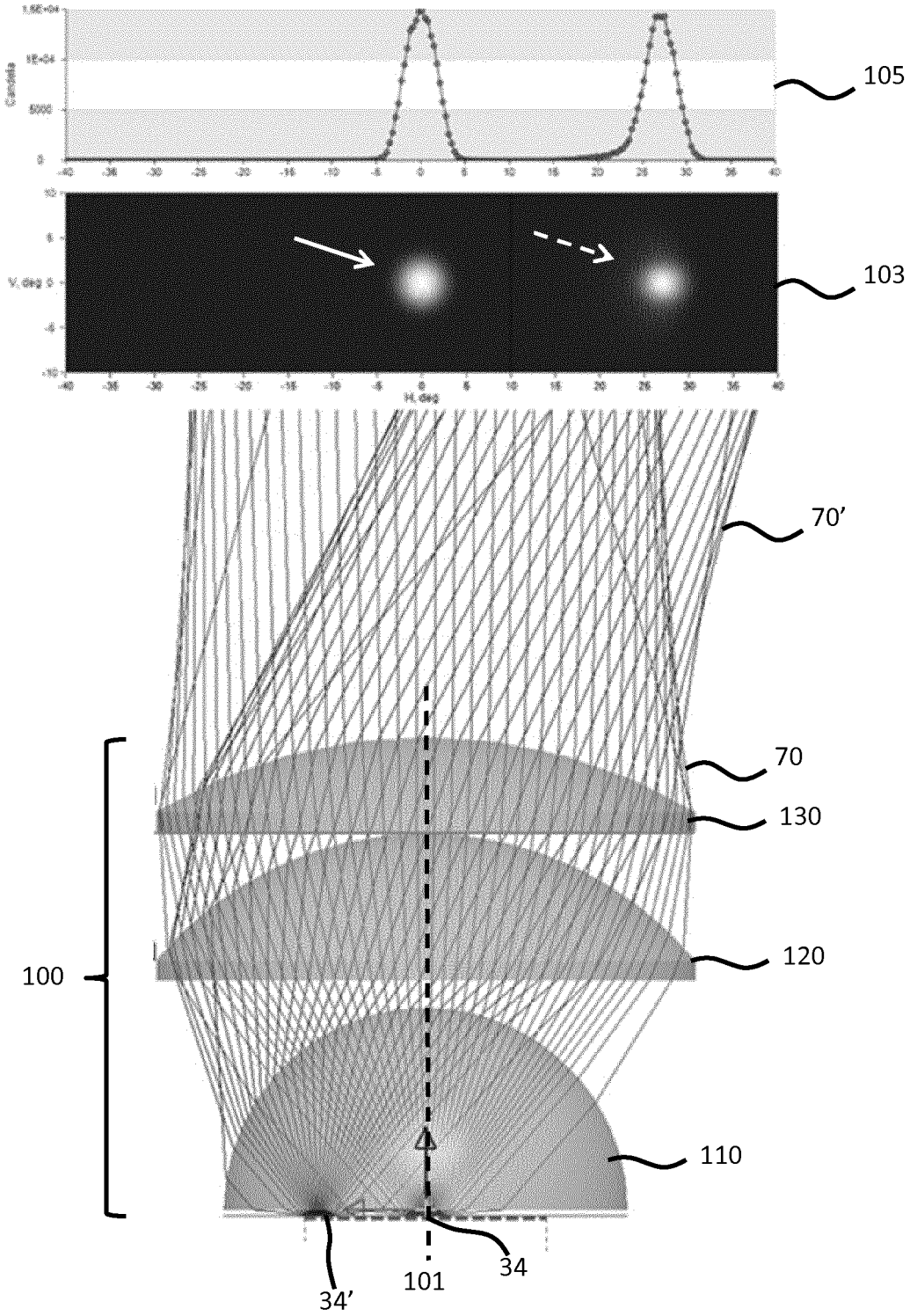
FIG. 11 schematically depicts the optical functionality of the example lighting device of FIG. 10.

As can be seen in FIG. 11, the optical system 100 images the luminous distribution of the lighting elements 34 as a function of the position of the lighting element 34 relative to the optical axis 101 of the optical system 100, as exemplified by a first lighting element 34 positioned on the optical axis 101 having its luminous distribution 70 shaped (collimated) along the optical axis 101, with a second lighting element 34' being axially displaced relative to the optical axis 101 having its luminous distribution 70' shaped (collimated) under a non-zero angle with the optical axis 101, with the magnitude of this angle being a function of the amount of axial displacement of the lighting element 34 relative to the optical axis 101. The luminous distribution 70 leads to the projection of a first spotlight as indicated by the solid arrow in the pane 103 along the optical axis 101 whereas the luminous distribution 70' leads to the projection of a second spotlight as indicated by the dashed arrow in the pane 103 that is axially displaced relative to the optical axis 101. The pane 105 depicts the luminance distributions of the respective spotlights in the pane 103. In this manner, by addressing selected sets of lighting elements 34 based on their position in the array relative to the optical axis 101, the projection direction of the spotlight generated with the optical system 100 may be controlled.

The first refractive lens 110 preferably has a height H1 of at least 0.9 times its radius r1, in order to achieve a sufficiently high refractive power of this first refractive lens. In an embodiment, the height H1 equals the radius r1, i.e. the first refractive lens 110 is a hemispherical lens. If the height H1 would be less than 0.9 times the radius r1, the refractive power of the first refractive lens 110 would be diminish, thereby putting higher demands on the refractive power of downstream lenses of the optical system 100, which would require an increase in the size of such downstream lenses, thereby increasing the overall size of the optical system 100 and reducing its efficiency. In a further preferred embodiment, the height H1 does not exceed 1.3 times the radius r1 in order to limit the amount of internal reflection within the first refractive lens 110, which internal reflection reduces the optical efficiency of the lens.

The first refractive lens 110 preferably has a diameter (2*r1) that is larger than the diameter or largest cross-section of the array of lighting elements 34 such that the first refractive lens 110 can collect substantially all light emitted by the lighting elements 34 independent of the position of the lighting elements 34 within the array. For this reason, the planar light entry surface 111 of the first refractive lens 110 preferably is positioned as close as possible to the array of lighting elements 34 to maximize the optical efficiency of the optical system 100, although a small gap between the planar light entry surface 111 of the first refractive lens 110 and the array of lighting elements 34 may be present, e.g. a gap of about 1 mm. This gap preferably does not exceed the pitch of the lighting elements 34 in the array and more preferably is less than or equal to half this pitch.

Due to the fact that the light distribution exiting the first refractive lens 110 through its convex light exit surface 113 still is divergent (although to a lesser degree than the luminous distribution of the light produced by the lighting elements 34), the one or more refractive lenses 120, 130 have a larger diameter than the first refractive lens 110 in order to harvest substantially all light exiting the first refractive lens 110. The first further refractive lens 120 may be separated from the first refractive lens 110 by a spacing or a gap having a dimension D, which dimension D may be based on the radius r1 of the first refractive lens 110. For example, the dimension D may be up to about 0.30*r1, e.g. a spacing or gap in a range of about 6-8 mm for a first refractive lens 110 having a radius r1 of 30 mm, although alternatively this spacing or gap may be absent, i.e. the light entry surface 121 of the first further refractive lens 120 may contact the light exit surface 113 of the first refractive lens 110. The respective lenses of the optical system 100 may be spherical or aspherical. The respective heights H2, H3 of the first further refractive lens 120 and, if present, the second further refractive lens 130 may be optimized in accordance with the position of these lenses within the optical system 100 and the desired optical function of the optical system 100 as will be readily understood by a skilled person.

Figure 12:
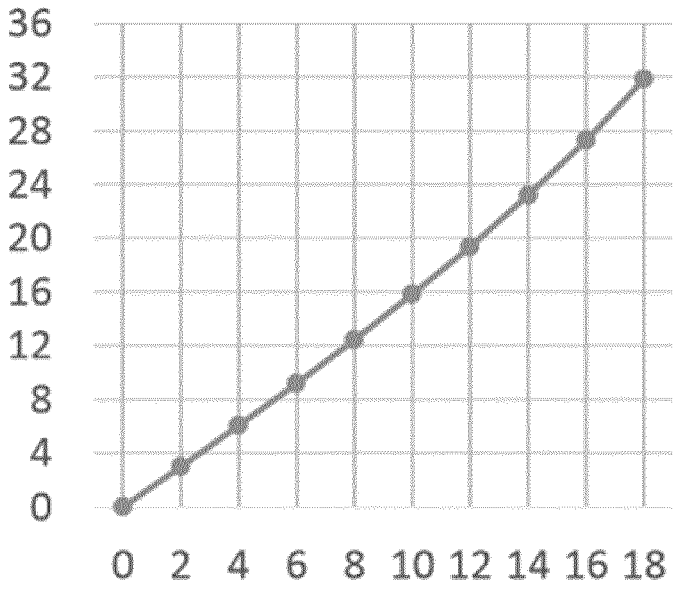
FIG. 12 is a graph depicting the angle between an optical axis of the optical system of the lighting device of FIG. 10 and the direction in which spotlight is projected by the lighting device.

The spatial resolution of the array of lighting elements 34 is determined by the pitch of the lighting elements 34 in the array. This spatial resolution is associated with the angular resolution, i.e. 'angular pitch', in the final light distribution as determined by the optical system 100. In this context, 'angular pitch' denotes the angular difference between the final central light direction of a lighting element 34 after imaging by the optical system 100 as previously explained and the final central light direction of a neighbouring lighting element 34 in the array. This angular pitch preferably is approximately constant over the total angular range of the lighting device 52, as schematically depicted in FIG. 12, which depicts the angle between the optical axis 101 and the final central light direction of a lighting element 34 as a function of the axial displacement (in mm) of the lighting element 34 relative to the optical axis 101. In other words, the angular pitch on the optical axis of the spotlight 12 is about the same as the angular pitch at the outer angular range of the spot as illustrated in FIG. 12.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting system comprising:

an array of lighting elements, each of said lighting elements having a configurable light output intensity;

a controller operatively coupled to said array and configured to individually control the light output intensities of said lighting elements in order to generate a configurable light effect in a configurable location on the array, the configurable light effect having a configurable luminance distribution exhibiting a defined edge steepness, wherein:

the controller is responsive to a control instruction, instructing the controller to migrate at a speed a current light effect in a first location to a second location spatially separated from the first location along a path between the first location and the second location;

wherein the controller is adapted to reduce the edge steepness of the luminance distribution of the current light effect for the duration of its migration along said path and only in the event that the speed at which said current light effect is to be migrated is below a threshold speed level.

2. A lighting system as claimed in claim 1, wherein the controller is adapted to reduce said edge steepness only if the steepness exceeds a pre-defined threshold.

3. A lighting system as claimed in claim 1, wherein said array has a defined pitch, and wherein the controller is adapted to identify a width of said edge of the luminance distribution and to reduce the edge steepness only if said identified width is less than a width of said defined pitch.

4. A lighting system as claimed in claim 1, wherein the controller is adapted to maintain a constant total luminous flux of the light effect upon reducing said edge steepness of the luminance distribution.

5. A lighting system as claimed in claim 1, wherein the controller is adapted to reduce said edge steepness by increasing the total area covered by the light effect and spreading the edge of the light effect outwards into said increase in area.

6. A lighting system as claimed in claim 1, wherein the migrated light effect at the second location is different to the light effect at said first location.

7. A lighting system as claimed in claim 1, wherein the luminance distribution of the current light effect at least partially follows a Gaussian distribution, and wherein the controller is adapted to reduce said edge steepness of the distribution through increasing a width of said Gaussian distribution.

8. A lighting system as claimed in claim 1, wherein said threshold speed level is 5 m/s, 2 m/s or 1 m/s.

9. A lighting system as claimed in claim 1, wherein the light output intensities of said lighting elements has a refresh rate requiring a certain refresh time and wherein a movement of the light effect from one lighting element to its adjacent lighting element has a certain moving time, and wherein the moving time is larger than the refresh time or the moving time is twice the refresh time.

10. A lighting system as claimed in claim 1, wherein the lighting elements of the array are arranged in a grid formation defined by a set of intersecting axes, and wherein the controller is adapted to reduce said edge steepness only in the case that at least a portion of said path between said first location and said second location extends relative to any of said axes defining said grid at an angle which exceeds a defined threshold angle ($\alpha$).

11. A lighting system as claimed in claim 1, wherein the lighting system further comprises a data communication interface communicatively coupled to the controller, for receiving said control instruction, and optionally wherein the data communication interface is for receiving one or more user input commands.

12. A lighting system as claimed in claim 1, wherein the controller is adapted to reduce said edge steepness in a continuous manner.

13. A method of generating a configurable light effect through control of an array of lighting elements, the lighting elements each having a configurable light output intensity and the configurable light effect having a configurable luminance distribution exhibiting a defined edge steepness, and the method comprising:

controlling the lighting elements to migrate at a speed a current light effect in a first location to a second location spatially separated from the first location on the array along a path between the first location and the second location, setting a threshold speed level below which edge steepness reduction is activated, and further comprising reducing said edge steepness of the luminance distribution of the current light effect for the duration of its migration along said path only in the event that the speed at which said current light effect is to be migrated is below said threshold speed level.

14. A method as claimed in claim 13, wherein said edge steepness is reduced only if the steepness exceeds a pre-defined threshold.

15. A method as claimed in claim 13, wherein said edge steepness of the luminance distribution is reduced while maintaining a constant total luminous flux of the light effect.

* * * * *